US005692875A

United States Patent [19]

Boman

[11] Patent Number: 5,692,875

[45] Date of Patent: Dec. 2, 1997

[54] CHUTE ASSEMBLY FOR A BUCKET OR SCOOP

[76] Inventor: Daniel J. Boman, Rte. 1, Box 34BB, Rosebud, Mo. 63091

[21] Appl. No.: 618,849

[22] Filed: Mar. 20, 1996

[51] Int. Cl.[6] ..... E02F 3/407

[52] U.S. Cl. ..... 414/725; 414/912; 37/903

[58] Field of Search ..... 414/722, 724, 414/725, 912; 37/426–431, 444, 445, 903; 222/460, 533, 538, 502

[56] References Cited

U.S. PATENT DOCUMENTS

| | | | |
|---|---|---|---|
| 2,901,148 | 8/1959 | Cunningham et al. | 222/502 X |
| 3,517,863 | 6/1970 | Graham | 222/460 |
| 4,068,771 | 1/1978 | Zimmerman | 414/722 X |
| 4,143,777 | 3/1979 | Nemtsov et al. | 222/502 X |

FOREIGN PATENT DOCUMENTS

| | | | |
|---|---|---|---|
| 435796 | 7/1991 | European Pat. Off. | 37/444 |
| 456589 | 11/1936 | United Kingdom | 414/722 |

OTHER PUBLICATIONS

Aberdeen's Concrete Construction, vol. 41, No. 4, Apr. 1996, p. 339, Mud Bucket Concrete Hauler.

ConExpo–Con/Agg '96, Las Vegas, NV, Mar. 20–24, 1996, Auger Bucket, Talet Equipment International Ltd.

ConExpo–Con/Agg '96, Las Vegas, NV, Mar. 20–24, 1996, Concrete Placement Bucket, Star Industries.

Palm Sales, Inc., Palm Attachments catalog, ©Dec. 1995, p. 10, Bucket Chute, p. 11, Kargo–Kart.

*Primary Examiner*—Donald W. Underwood

*Attorney, Agent, or Firm*—Grace J. Fishel

[57] ABSTRACT

A chute assembly in a bucket or scoop designed to be mounted on a front end loader or the like having a boom or lift arms for raising, lowering and controlling fore-aft pitch of the bucket. The bucket or scoop has an interior chamber and the chute assembly has a pair of converging sidewalls mounted on a plate forming a funnel, preferably with an adjustable throat for spreading flowable materials. The sidewalls of the chute are adapted to make a sealing fit with the sidewalls of the bucket, as does the plate along its bottom wall, joining the funnel and the interior chamber and forming a hopper. The chute assembly has means for attachably and detachably securing the plate to the bottom wall of the bucket. In one embodiment, a power ram drive mechanism swings the chute assembly in and out of the bucket on lift arms attached to the bucket.

8 Claims, 5 Drawing Sheets

CHUTE ASSEMBLY FOR A BUCKET OR SCOOP

BACKGROUND OF THE INVENTION

1. Field of the Invention

The present invention relates to a chute assembly which is part of a specialized bucket or scoop or which is provided as an accessory for attachment to an existing bucket or scoop for use in pouring concrete, sand, gravel or other flowable material. The bucket or scoop is of the kind mounted on a construction vehicle such as a front end loader. The chute assembly is releasably secured for quick attachment to the bucket or scoop so that the work attachment may be used in a normal manner.

2. Brief Description of the Prior Art

During construction of footings and foundations, gravel and concrete are poured from a container. The container may be mounted on a vehicle so that it can be driven along a trench or form, pouring the flowable material where it is required. The equipment presently available for this task requires some other piece of equipment, such as a front end loader, to fill the container which is then carried to the construction site. An example of prior art equipment for pouring gravel and concrete is a Kargo Kart sold by Palm Sales, Inc. The Kargo Kart is mounted on a front end loader, includes a dump body that is hydraulically tipped and allows an operator to carry and discharge the flowable material (such as concrete) by pouring it over the side of the container. Precise delivery of the material is difficult as the dump body does not have a spout. The Kargo Kart is an extra piece of equipment, whose possession is justified only if the owner pours a lot of concrete and requires a second front end loader or some other piece of equipment to fill it.

Palm Sales Inc. also sells a detachable chute that is chained in a bucket on a front end loader and is useful for pouring concrete. The chute, however, is not quickly detachable, nor does it rotate out of the way so that the bucket can be used in a normal manner without detaching the chute. In addition, the throat of the chute does not appear to be adjustable so that flow cannot be finely controlled. Like the Kargo Kart, the chute requires a second piece of equipment to fill it.

To overcome the problems with the chute sold by Palm Sales, a better chute accessory would detach quickly or be rotated out of the way so that the bucket could be used in a normal manner. If the chute accessory is rotated out of the way, the operator could fill the bucket in a usual manner, rotate the chute back into place and then pour the material through the chute without the need for a second piece of equipment, which might otherwise stand idle while pouring was going on.

SUMMARY OF THE INVENTION

In view of the above, there is a need for a chute assembly that can be provided as an accessory to an existing bucket or scoop or sold as part of a specialized work attachment. Such a chute assembly should be easily detachable or pivotable out of the way so that the bucket or scoop can be used in a normal way, either for the purpose of picking up material to be poured through the chute or for the purpose of moving material in general. The chute assembly should also be adjustable to control the flow of material.

It is therefore an object of the present invention to provide a chute assembly that can be mounted on a bucket or scoop as an accessory or that can be built as an integral part of a specialized work attachment. It is another object to provide a chute assessory that can be releasably secured to a bucket or scoop for quick change attachment with the pull of a pin or the like. In a preferred embodiment of the chute assembly, it is also an object to provide a chute assembly that can be pivoted out of the way so that the bucket or scoop may be used in an ordinary manner. A further object is to provide a chute assembly that is adjustable to control the flow of material. Other objects and features of the invention will be in part apparent and in part pointed out hereinafter.

In accordance with the invention, a chute assembly is used with a bucket having a rear wall, a bottom wall with a lip along a forward edge and opposing sidewalls along side edges of the bottom wall. The rear wall, bottom wall and sidewalls define an interior chamber therebetween. The bucket is adapted for attachment to a construction vehicle with a boom or lift arms for raising, lowering and controlling fore-aft pitch of the bucket.

The chute assembly includes a pair of opposing sidewalls mounted on a plate for maintaining the sidewalls in generally vertically disposed, laterally spaced apart and converging position relative to each other, forming a funnel. The sidewalls of the chute assembly are adapted to make a sealing fit with the sidewalls of the bucket and the plate is open at the rear and adapted to make a sealing fit along the lip of the bucket. There are means for quick attachment and detachment of the plate to the bottom wall and for attachment and detachment of the entire unit from the bucket. Flowable material can be directed through the funnel when the bucket is lifted and tilted by the construction vehicle. In some of the embodiments disclosed hereinafter, the throat of the funnel is adjustable and a power ram drive mechanism is provided for swinging the chute assembly in and out of the bucket.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
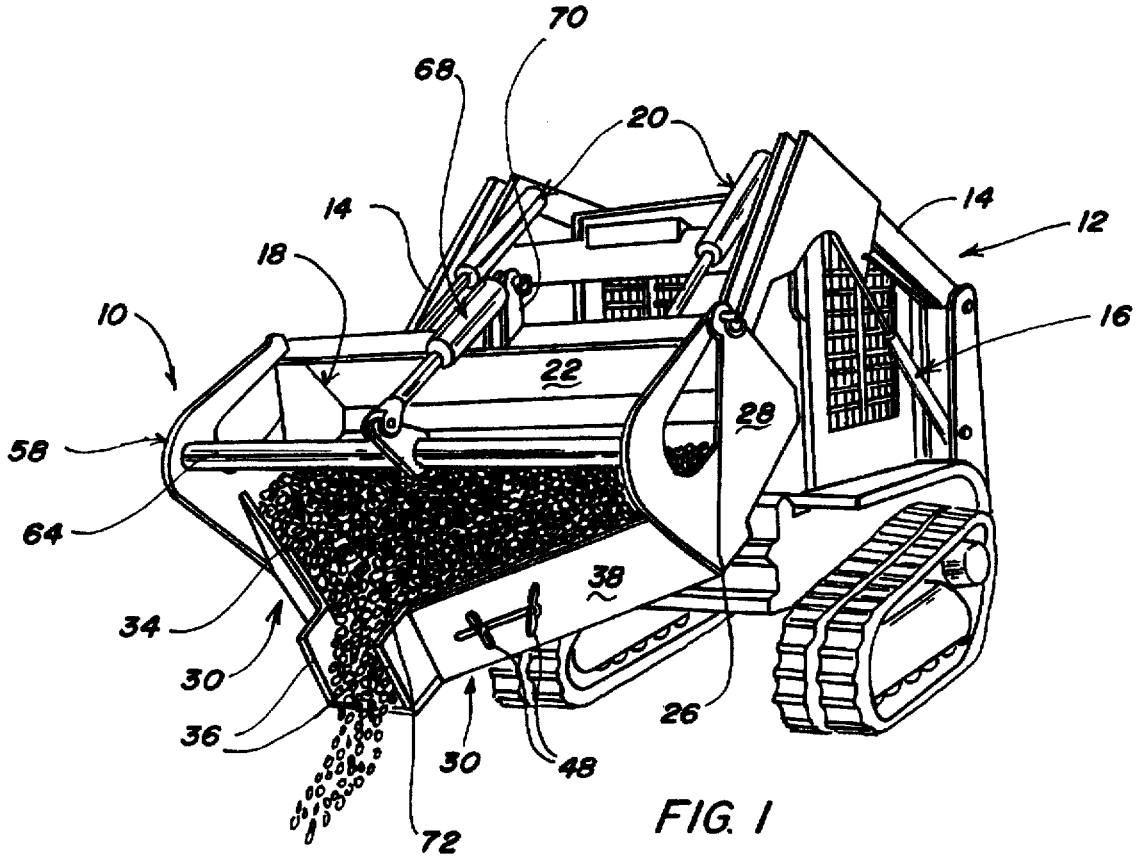
FIG. 1 is a perspective view of a chute assembly in use on a front end loader in accordance with the present invention.

Referring to the drawings more particularly by reference character, reference numeral 10 refers to a chute assembly which is part of a specialized bucket or scoop or which is provided as an accessory for attachment to an existing bucket or scoop, mounted on a construction vehicle 12 with a boom or lift arms for raising, lowering and controlling fore-aft pitch of the bucket. Construction vehicles of this type include front end loaders, forklifts, backhoes and any similar motor vehicle. Chute assembly 10 can be used for spreading flowable materials such as sand, gravel, crushed rock, concrete and wood mulch, which are common materials used in construction and landscaping work, but its utility is not limited to this list which is set forth by way of illustration, not limitation.

The construction vehicle shown in the drawings is a front end loader, and in particular a skid-steer loader, because it is the machine most likely to be available to a contractor doing construction work. It will be apparent, however, that any type of construction equipment to which a similar bucket can be attached and operated can be used in connection with the practice of the invention. In general terms, front end loaders 12 comprise a tractor-type vehicle equipped with a pair of lift arms 14 connected to the vehicle for vertical positional adjustment in response to operation of at least one hydraulic lift unit 16. The front ends of lift arms 14 are connected generally to opposite ends of a work attachment such as a bucket 18, or to opposite ends of an adapter mounting plate designed for quick release removable connection to the work attachment. In addition, at least one hydraulic pitch control unit 20 for controlling fore-aft pitch of the bucket is connected between the vehicle and bucket 18, or the adapter mounting plate therefore, above the connection to lift arms 14. Hydraulic lift unit 16 and hydraulic pitch control unit 20 are usually driven by pumps located, for example in the rear of the vehicle and directly geared to the motor shaft of the vehicle engine, there being regulating valves in the loader cab for controlling the lifting operation. Sometimes hydraulic actuator units (not shown) are also provided for controlled lateral roll and/or slewing of the work attachment.

Bucket 18 for use with chute assembly 10 has a rear wall 22, a bottom wall 24 with a lip 26 and opposing sidewalls 28 along side edges of the bottom wall. The rear wall, bottom wall and sidewalls of bucket 18 define an interior chamber therebetween. In simple form, as shown in FIGS. 9–12, chute assembly 10 is bolted into bucket 18 and includes a pair of opposing sidewalls 30, of opposite hand, mounted on a plate 32. Plate 32 maintains sidewalls 30 in generally vertical, spaced apart condition. Sidewalls 30 converge relative to each other and with plate 32 form a funnel. Plate 32 is open at the rear and is adapted to make a sealing fit along lip 26 of bucket 18. Sidewalls 30 and plate 32 of chute assembly 10 define an interior chamber therebetween that when joined with the chamber defined by the rear wall, bottom wall and sidewalls of bucket 18 form a hopper 34.

At least one of sidewalls 30 may be adjustable in length on that end of the sidewalls where the sidewalls converge. As shown in full lines in FIG. 11, in combination with other of FIGS. 9–12, this adjustability is achieved when sidewalls 30 are Z-shaped in plan with a shorter leg 36, more particularly described below, joined to an elongated back 38. A longer leg 40 of sidewalls 30 is attached to back 38 opposite shorter leg 36, with longer leg 40 slip fitting between sidewalls 28 of bucket 18 and forming a seal therewith. Shorter leg 36 forms a throat 42 of funnel when paired with its counterpart, the width of which may be made adjustable for the purpose of metering flow from hopper 34. To this end, at least one of sidewalls 30 is formed in two segments, joined along backs 38, one segment carrying shorter leg 36 and the other carrying longer leg 40. The segment with longer leg 40 is fixed on plate 32 whereas the segment with shorter leg 36 is slidable so that throat 42 can be opened and closed. An elongated slot 44 is provided in the back of the segment with longer leg 40 and a fastener, such as bolts 46 are attached to the segment with shorter leg 36. Bolts 46 pass through slot 44 for threaded receipt of a nut 48, such as wing nuts, by means of which the segment with shorter leg 36 is locked in selected relationship with the segment with the longer leg 40.

Plate 32 is generally isosceles in shape and, in the form shown in FIGS. 9–12, partially overlies bottom wall 24 of bucket 18. Plate 32 is adapted to fit between sidewalls 28 of bucket 18, rearward of lip 26, and to extend forwardly beyond the lip of the bucket. Plate 32 includes a centrally located tab 50 along its rear edge by means of which chute assembly 10 is attached to bottom wall 24 of bucket 18 with a fastener such as a bolt 52. Tab 50 is provided for the purpose of effecting attachment of chute assembly 10 while minimizing the weight and amount of material in plate 32. The segment of sidewalls 30 with longer leg 40 are notched along a bottom edge at 54 to conform with the profile of lip 26, sandwiching the lip between plate 32 and sidewalls 30 and stabilizing attachment of the chute assembly to the bucket. Notch 54 and tab 50/bolt 52 provide means for quick change attachment and detachment of the plate to the bottom wall of bucket 18. A second tab 56, which like tab 50 may be formed as an integral portion of plate 32, is provided at an apex of triangular plate 32, forming the floor of throat 42 and a base across which slide the adjustable sections of sidewalls 30. The width of second tab 56 and the proportions of the other components of chute assessory 10 may vary depending on the nature of the flowable material to be spread. For example, when the material is wood chips or the like, throat 42 may need to be larger to keep the material from bridging and to deliver the material is a wide strip such as to mulch a path. These changes, depending upon the intended end use of chute assembly 10, are within the skill of those skilled in the art.

As shown in full lines in FIGS. 9–12, material is poured from chute assembly 10 in line with the direction of travel of construction vehicle 12. In this form, for example, construction vehicle 12 may be driven so as to straddle a trench, dropping material from hopper 34 as it moves. Sometimes, however, it is advantageous that chute assembly 10 be designed for side discharge, one of such possible modifications being shown in broken lines in FIG. 11, while others will readily occur to those skilled art as part of the present invention. For example, the height of sidewalls 30 may vary to force the material to one side. Chute assembly 10 in FIGS. 9–12 requires the use of another piece of construction equipment for the purpose of filling hopper 34. Its primary advantage over the prior art lying in the ease with which it can be attached and detached from bucket 18 and the precision with which it can be used to meter flowable material when the throat is adjustable.

The chute assembly shown in FIGS. 1–8 is a variant of that described in connection with FIGS. 9–12 but includes additional features that allow it to be rotated out of bucket 18 so that the bucket can be used for filling hopper 34 without the need of another piece of construction equipment.

With continuing reference to FIGS. 1–8, chute assembly 10 includes a plate 32 and sidewalls 30 as described above except that plate 32 sealingly engages bottom wall 24 of bucket 18 at lip 26, and a pair of lift arms 58 are attached to sidewalls 30 of chute assembly 10, opposite that end of the sidewalls where the sidewalls converge. As perhaps best seen in FIGS. 5–6, a lower end of lift arms 58 is attached to the sidewalls and forms longer leg 40 thereof. The lower end of leg 40 follows the contours of a forward edge of bucket sidewalls 28 and includes a heel 60 to block material from escaping under chute assembly 10 at the junction between sidewalls 28 and lip 26. Lower end of leg 40 nest inside sidewalls 28 a distance not much more than sufficient to make a sealing fit as the material in hopper 34 tends to resist such insertion.

An upper end of each lift arm 58 is pinned between a pair of ears 62 which are attached on opposite sides and on a top edge of rear wall 22, defining a laterally extending arm axis about which the arms swing up and down, located at the rear of bucket 18 and at a level well above chute assembly 10 when it is swung down and nested in bucket 18. Lift arms 58 are joined by a laterally extending cross brace 64, which attachment is reinforced with gussets 66.

Figure 2:
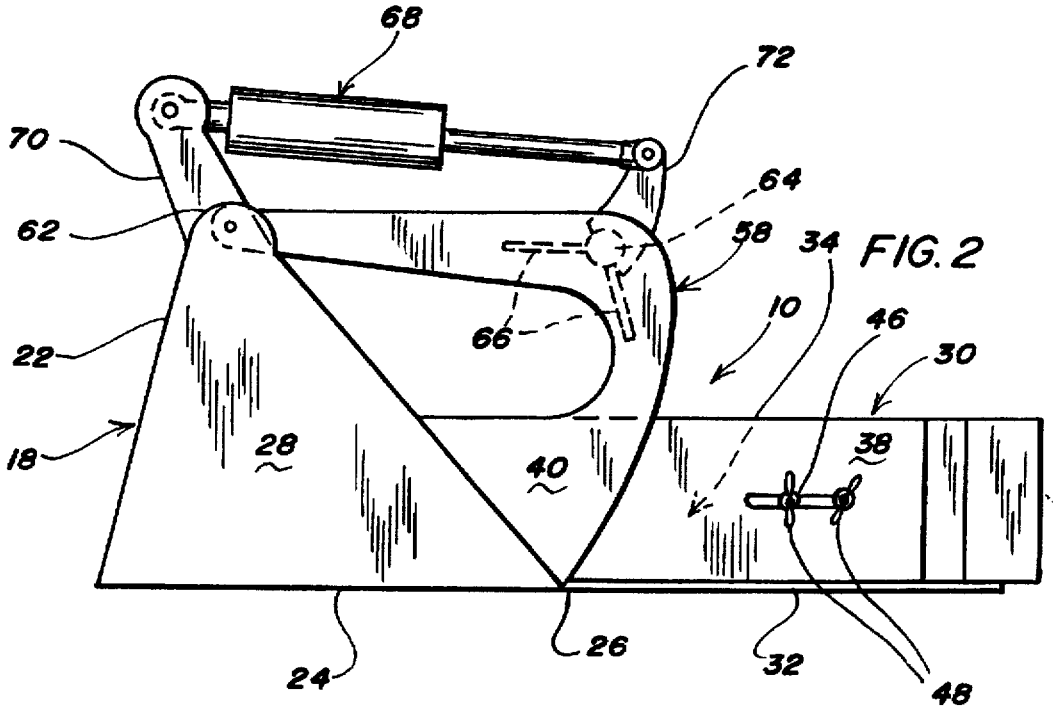
FIG. 2 is a side elevational view of the chute assembly.
Figure 3:
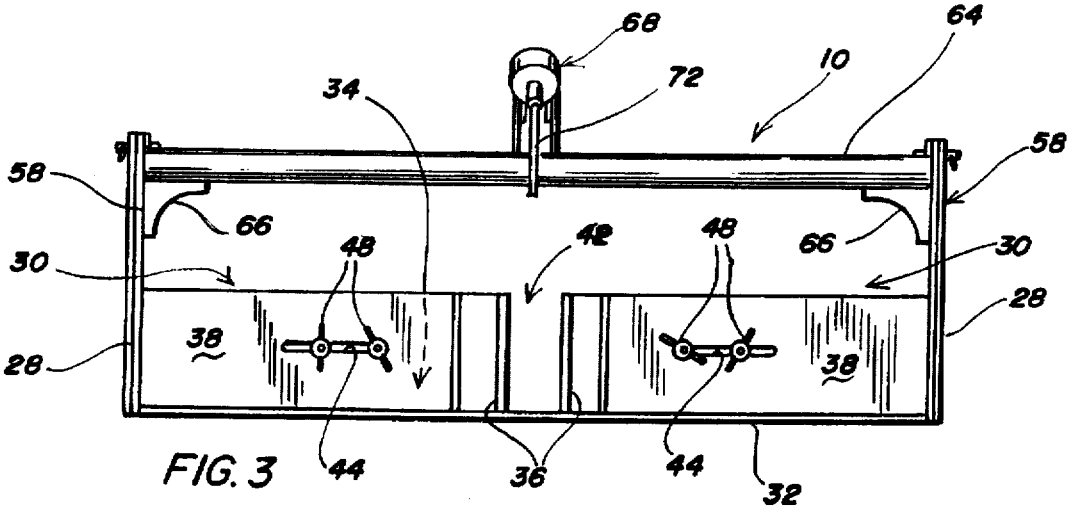
FIG. 3 is a front elevational view of the chute assembly.
Figure 4:
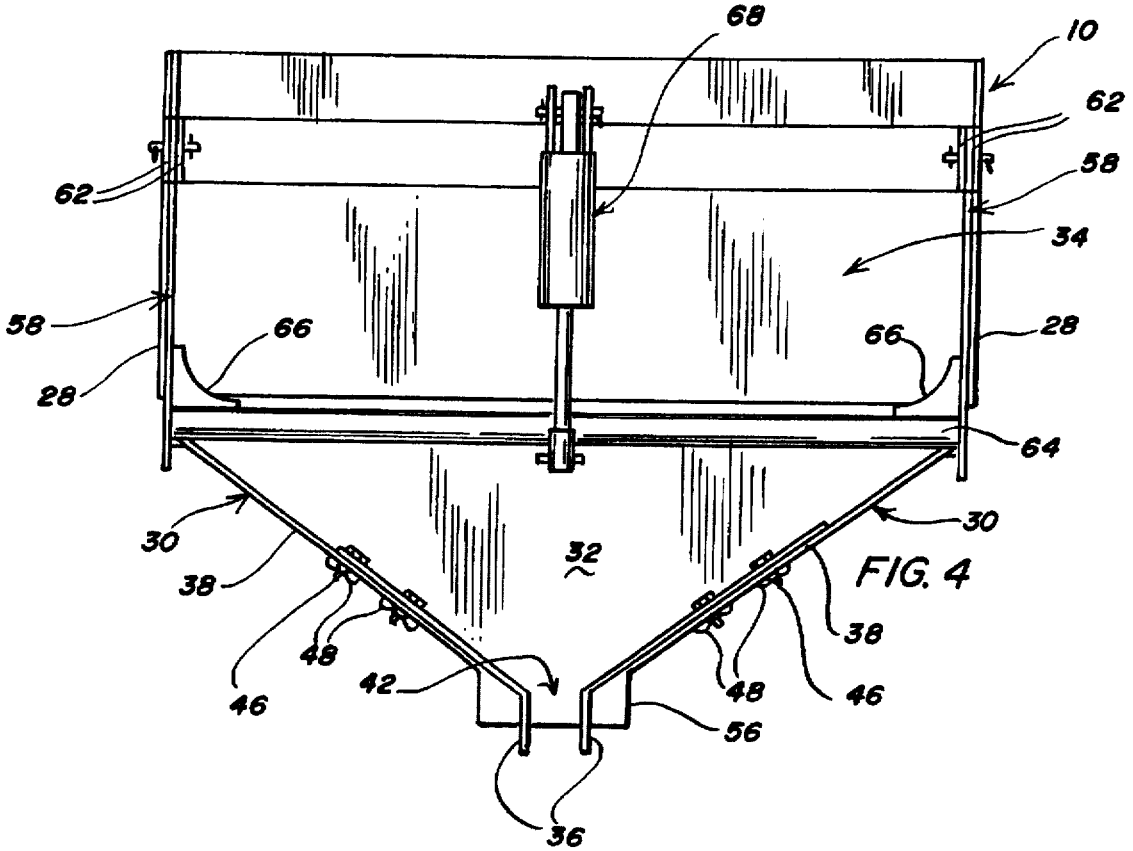
FIG. 4 is a plan view of the chute assembly.
Figure 5:
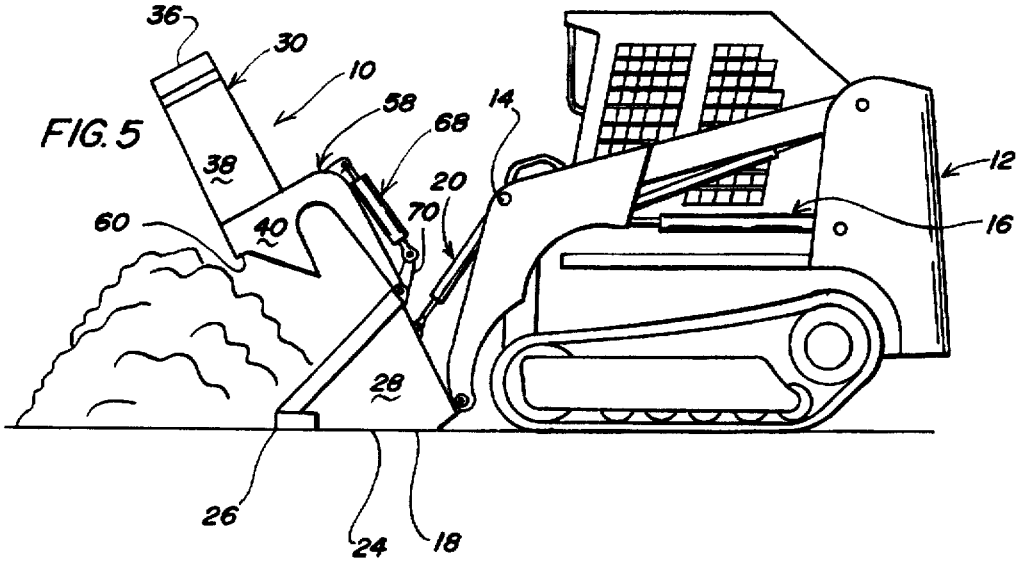
FIG. 5 is a side elevational view of the chute assembly swung up while the front end loader fills the bucket with flowable material.
Figure 6:
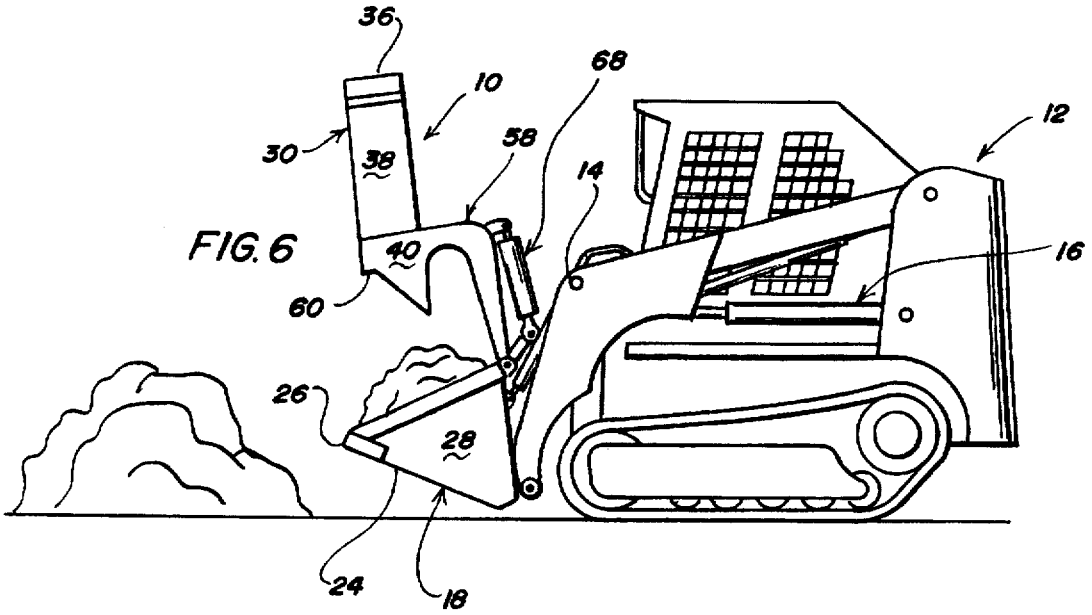
FIG. 6 is a side elevational view of the chute assembly after the front end loader has filled the bucket.
Figure 7:
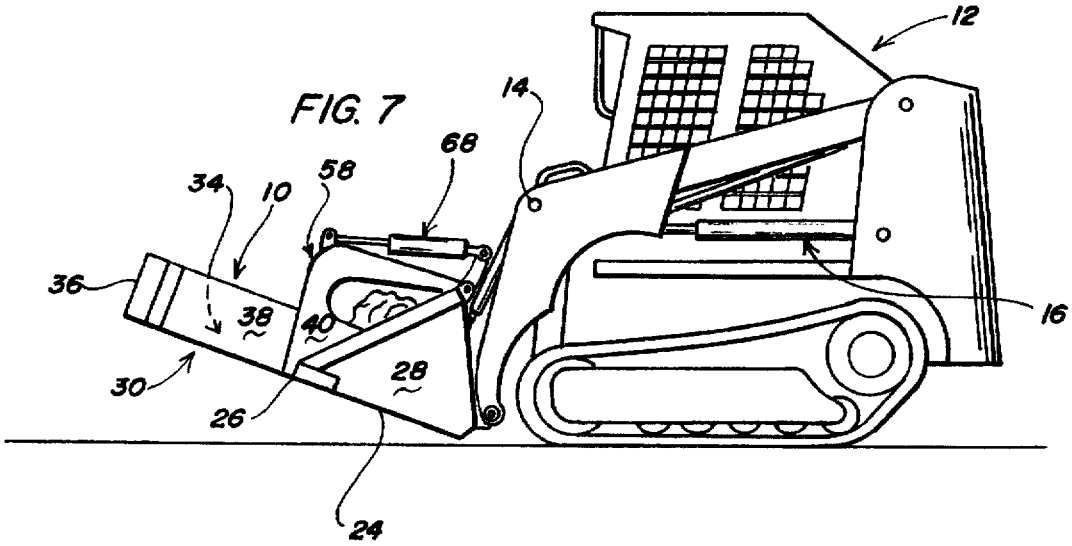
FIG. 7 is a side elevational view of the chute assembly swung down into the bucket.
Figure 8:
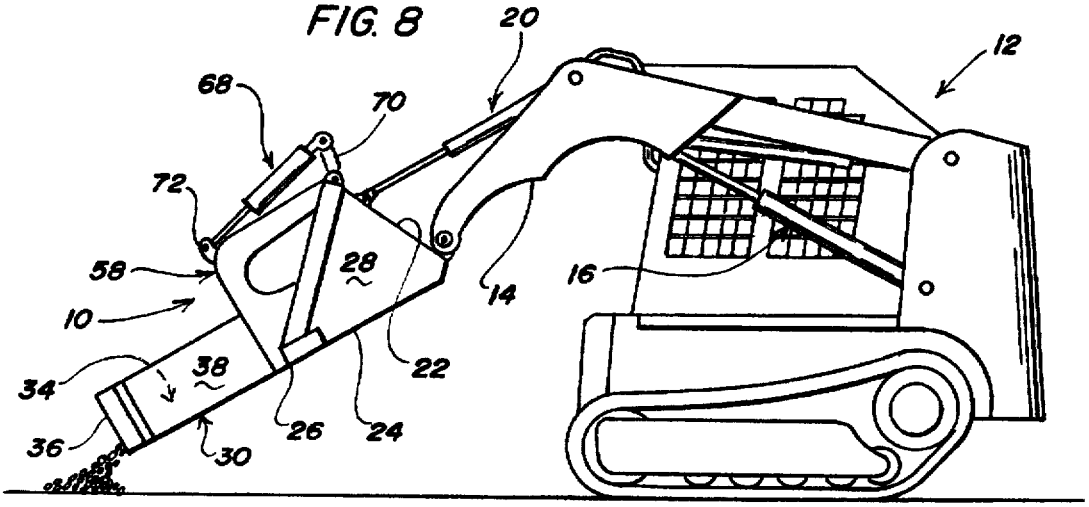
FIG. 8 is a side elevation view of the chute assembly spreading flowable material.
Figure 9:
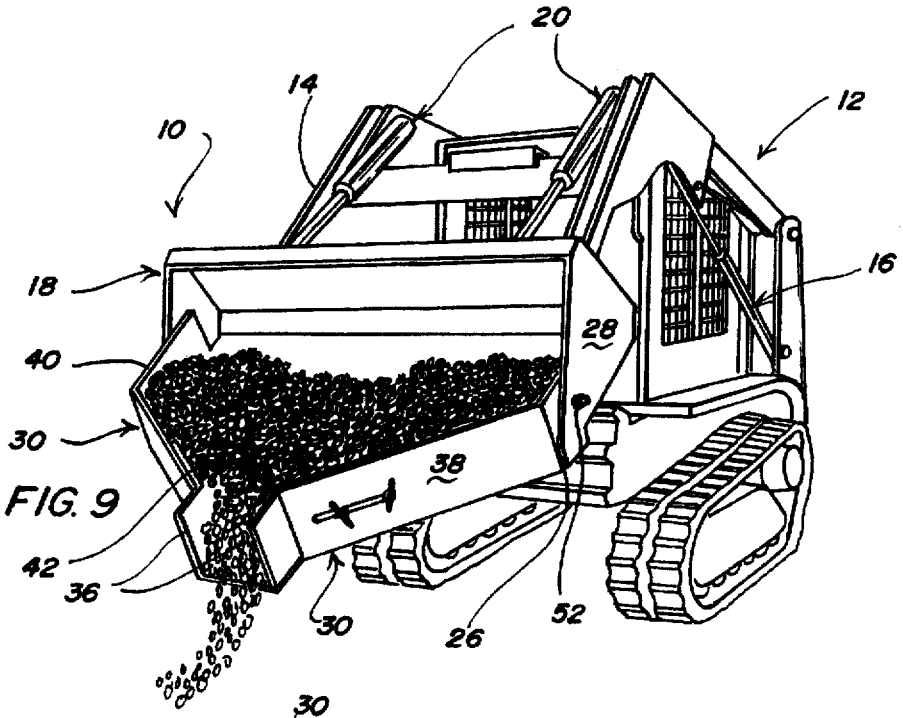
FIG. 9 is a perspective view of a second chute assembly in use on a front end loader in accordance with the present invention.
Figure 10:
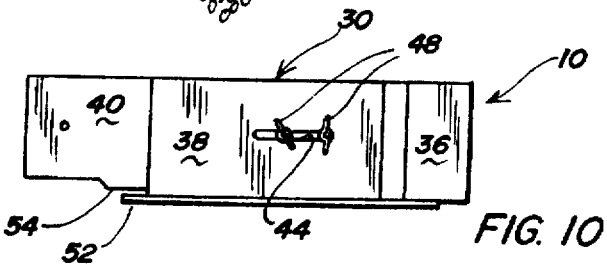
FIG. 10 is a side elevational view of the second chute assembly.
Figure 11:
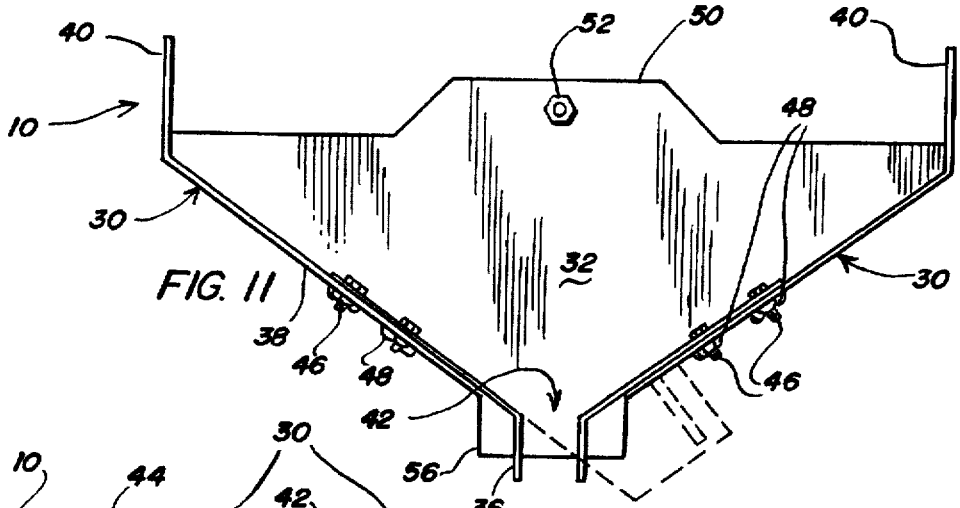
FIG. 11 is a plan view of the second chute assembly.
Figure 12:
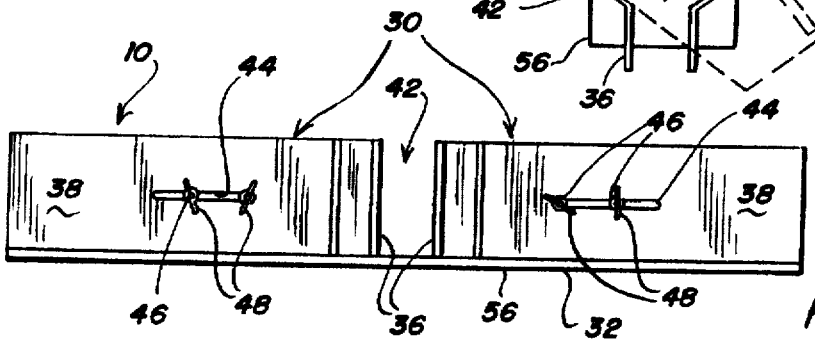
FIG. 12 is a front plan view of the second chute assembly.

At least one power ram drive mechanism 68 is connected between bucket 18 and cross brace for swinging lift arms 58 about the arm axis and providing means for attachably and detachably securing the chute assembly to the bottom wall of the bucket. As best seen in FIG. 2, power ram drive mechanism includes a double-acting hydraulic cylinder but it will be understood that a motorized power screw or the like may be used in place thereof. One end of hydraulic cylinder actuator 68 is pinned adjacent an end of a stanchion 70 centrally attached to a top edge of rear wall 22 of bucket 18. The other end of hydraulic cylinder actuator 68 (shown as a piston rod) is pinned to cross brace 64 adjacent an end of a second stanchion 72 which is centrally attached to cross brace 64 to provide operating clearance. Hydraulic cylinder actuator 68, under control of valves in the loader cab, can be connected to the hydraulic system of construction vehicle 12 through quick disconnect couplings in a known manner. Release of hydraulic fluid from one side of double acting hydraulic cylinder actuator 68 will raise chute assembly 10 on lifting arms into the position shown in FIGS. 5 and 6 depending upon the limit of contraction of the actuator. Upon reintroduction of fluid into the one side of actuator, the chute assembly 10 on arms will be lowered and held by the actuator in the position shown in FIGS. 1–4 and 7–8. For picking up material to be dumped through chute assembly 10, lift arms 58 are swung upwardly as shown in FIGS. 5–6, in which condition construction vehicle can fill bucket 18 in a normal manner. After bucket is filled, lift arms 58 are swung downwardly as shown in FIGS. 7–8, and the hydraulic lift unit 16 and hydraulic pitch control unit 20 deployed to dump the material through chute assembly 10 in a controlled manner. If it becomes desirable to remove chute assembly 10 from the bucket 18, this is easily accomplished by pulling pins from ears 62 and stanchion 70 and disconnecting hydraulic cylinder actuator 68 through the quick disconnect couplings. As will be readily apparent, chute assembly 10 can be provided as part of a specialized bucket or scoop or as an accessory for attachment to an existing bucket or scoop. The main difference being when ears 62 and stanchion 70 are attached to the bucket.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A chute assembly adapted for use on a bucket having a rear wall, a bottom wall with a lip along a forward edge and opposing side walls along side edges of the bottom wall, the rear wall, bottom wall and side walls defining an interior chamber therebetween, the bucket adapted for attachment to a construction vehicle with a boom or lift arms for raising, lowering and controlling fore-aft pitch of the bucket, said chute assembly comprising a pair of opposing sidewalls mounted on a plate for maintaining the sidewalls in generally vertically disposed, laterally spaced apart and converging position relative to each other, said sidewalls and plate forming a funnel;

said sidewalls of the chute assembly adapted to make a sealing fit with the sidewalls of the bucket;

said plate open at the rear and adapted to make a sealing fit along the lip of the bucket; and, a pair of lift arms attached to the sidewalls of the chute assembly opposite that end of the sidewalls where the sidewalls converge and shaped and positioned to attach to the bucket above the sidewalls of the chute assembly on pivots that define a laterally extending arm axis about which the arms swing up and down, at least one power ram drive mechanism adapted to be connected between the bucket and the lift arms for swinging the plate and sidewalls of the chute assembly in and out of the bucket and for maintaining the sealing fit between the plate and the bucket along the lip of the bucket, whereby flowable material can be directed through the funnel when the bucket is lifted and tilted by the construction vehicle.

2. The chute assembly of claim 1 wherein the funnel further narrows into a throat and at least one of said sidewalls has overlapping segments on that end of the sidewalls where the sidewalls converge, one of said segments slidable with respect to another for regulating the size of the throat whereby the flowable material directed through the funnel is metered by adjusting the length of the segmented sidewall.

3. The chute assembly of claim 2 wherein said sidewalls of the chute assembly are adapted to extend partially along the sidewalls of the bucket rearward of its lip and wherein said plate is adapted to at least partially overlay the bottom wall of the bucket, said plate adapted to fit between the sidewalls of the bucket rearward of the lip and to extend forwardly beyond the lip of the bucket.

4. The chute assembly of claim 3 wherein the plate is generally isosceles in shape and has a tab at its apex, forming an extension of the plate and a base across which the adjustable segmented sidewall can slide.

5. A chute assembly adapted for use on a bucket having a rear wall, a bottom wall with a lip along a forward edge and opposing side walls along side edges of the bottom wall, the rear wall, bottom wall and side walls defining an interior chamber therebetween, the bucket adapted for attachment to a construction vehicle with a boom or lift arms for raising, lowering and controlling fore-aft pitch of the bucket, said chute assembly comprising a pair of opposing sidewalls mounted on a plate for maintaining the sidewalls in generally vertically disposed, laterally spaced apart and converging position relative to each other, said sidewalls and plate forming a funnel narrowing into a throat;

at least one of said sidewalls having overlapping segments on that end of the sidewall where the sidewalls converge, one of said segments being slidable with respect to another for regulating the size of the throat;

a pair of lift arms attached to the sidewalls of the chute assembly opposite that end of the sidewalls where the sidewalls converge and adapted to be attached to the bucket above the sidewalls of the chute assembly on pivots that define a laterally extending arm axis about which the arms swing up and down, said lift arms interconnected by at least one cross brace, said lift arms and the sidewalls of the chute assembly adapted to make a sealing fit along the inside of the sidewalls of the bucket and partially overlapping the sidewalls of the bucket rearward of its lip;

said plate open at the rear and adapted to make a sealing fit along the lip of the bucket;

at least one power ram drive mechanism adapted to be connected between the bucket and the cross brace for swinging the plate and sidewalls of the chute assembly in and out of the bucket and for maintaining the sealing fit between the plate and the bucket along the lip of the bucket;

whereby flowable material can be directed through the funnel when the bucket is lifted and tilted by the construction vehicle in an amount metered by the throat through adjusting the length of the sidewalls.

6. The chute assembly of claim 5 wherein the power ram drive mechanism is a hydraulic actuator.

7. The chute assembly of claim 6 wherein a lower end of the lift arms is adapted to follow the contours of a forward edge of the sidewalls of the bucket and includes a heel to block material from escaping around the outside of the chute assembly at a junction between the sidewalls of the bucket and the bottom wall.

8. The chute assembly of claim 7 wherein the plate is generally isosceles in shape and has a tab at its apex, forming an extension of the plate and a base across which the adjustable segmented sidewall can slide.

* * * * *